United States Patent [19]

Gagliano

[11] Patent Number: 4,944,047

[45] Date of Patent: Jul. 31, 1990

[54] ROTATING HIDEAWAY SANITARY FIXTURE

[75] Inventor: Vitaliano Gagliano, Passignano Sul Trasimeno, Italy

[73] Assignee: A. T. Avanzata Tecnologia S.R.L., Italy

[21] Appl. No.: 328,039

[22] PCT Filed: Jul. 28, 1987

[86] PCT No.: PCT/EP87/00406

§ 371 Date: Mar. 22, 1989

§ 102(e) Date: Mar. 22, 1989

[87] PCT Pub. No.: WO88/00993

PCT Pub. Date: Feb. 11, 1988

[30] Foreign Application Priority Data

Jul. 29, 1986 [IT] Italy ..... 22674/86[U]

[51] Int. Cl.[5] ..... E03D 11/12

[52] U.S. Cl. ..... 4/312; 4/307; 4/DIG. 2

[58] Field of Search ..... 4/312, 307, 233, DIG. 2; 312/209, 229, 242, 248

[56] References Cited

U.S. PATENT DOCUMENTS

| | | | |
|---|---|---|---|
| 1,441,410 | 1/1923 | Eustis | 312/248 X |
| 2,076,950 | 4/1937 | Koch . | |
| 2,374,110 | 4/1945 | Lewis | 312/248 X |
| 2,552,546 | 5/1951 | Fergusson | 4/312 X |
| 2,593,455 | 4/1952 | James | 312/229 X |
| 2,678,450 | 5/1954 | Simpson et al. | 4/312 |
| 2,725,575 | 12/1955 | Colonna | 4/312 |
| 2,750,599 | 6/1956 | Colonna | 4/312 |
| 2,794,988 | 6/1957 | Colonna . | |
| 2,799,864 | 7/1957 | Colonna | 4/312 |
| 2,826,762 | 3/1958 | Colonna | 4/312 |
| 2,879,519 | 3/1959 | Mueller | 4/312 |
| 3,608,100 | 9/1971 | Trost . | |
| 3,977,044 | 8/1976 | Mort . | |

FOREIGN PATENT DOCUMENTS

| | | | |
|---|---|---|---|
| 71494 | 9/1950 | Denmark | 312/248 |
| 58677 | 9/1891 | Fed. Rep. of Germany . | |
| 3742760 | 8/1988 | Fed. Rep. of Germany | 4/415 |
| 1502879 | 11/1967 | France . | |

*Primary Examiner*—Henry J. Recla
*Assistant Examiner*—R. M. Fetsuga

[57] ABSTRACT

A sanitary rotating fixture (10, 10*a*), which conceals in a wall niche (11). The fixture is more or less triangular in shape when viewed from the side. It has a rear wall (13, 13*a*), an upper base (21, 21*a*), side walls (16, 16*a*), a sloping bottom (17, 17*a*) and a means of rotation (12, 23) permitting rotation for less than 90°, in particular of about 60° around a horizontal axis. Holding means, for example in the form of stops are provided for projecting caps (14) that slide in arch-shaped grooves (15) in the side walls of the niche (11). A plastic sheet (31) is provided to conceal flushing ducts thus preventing dirt accumulation on them and behind the fixture.

12 Claims, 3 Drawing Sheets

ROTATING HIDEAWAY SANITARY FIXTURE

The present invention concerns the sanitary ware normally installed in bathrooms and lavatories in general.

There are various known types of sanitary fixtures that take up a certain space in bathrooms. In some cases, for example in caravans and hotels, it is particularly important that the space set aside for the bathroom is reduced to a minimum and this is difficult to achieve using conventional sanitary ware.

U.S. Pat. No. 2,076,950 discloses a disappearing toilet made up of sheet iron. The toilet leans to a rotating plate. No traps are foreseen while a rear space filled with unaesthetic mechanisms is provided. This space is very difficult to clean and easily becomes a repository for dirt.

U.S. Pat. No. 2,794,044 also foresees a toilet made up of sheet iron and capable of rotating around a pivot. It also forms a rear space having all the above listed disadvantages.

Both documents have rigid waste pipes. This obliges a special adaptation for every installation, while the working must be very precise. Furthermore none of the two documents discloses a means for assemblying a ceramics fixture which must be handled with great care, said material being fragile and easily subject to splintering.

The purpose of the present invention is to create practical, functional sanitary fixtures that take up minimum space.

The purpose is achieved by creating rotating, hideaway sanitary fixtures.

The sanitary fixtures have more or less the shape of a right-angled triangle when viewed from the side, namely they have a more or less horizontal upper base from which originate a more or less vertical rear wall, right-angled triangle shaped side walls and a sloping bottom that joins the hypotenuses of the two right-angled triangles, a means for rotation of the sanitary fixture being provide in the lower rear part of the sanitary fixture so that it can be rotated around a horizontal axis through an arc of less than 90°; preferably about 60°.

The side walls preferably have a holding means to lock the sanitary fixture in the pulled out position. These means may consist of projecting caps fitted into a composite shaft inserted at the top of the rear wall. In this way the fixtures can be moved in and out of a niche in the bathroom wall. In order to do this the holding means in the form of projecting caps are made to enter special grooves provided in the side walls of the niche.

The projecting caps can enter the seat in which the composite shaft is accommodated by means of springs during assembly of the fixture; said springs, when they are pressed, cause the composite shaft to be shortened, thus pulling in the projecting caps, the fixture is supported on the lower pivots, the springs are compressed then the fixture is pushed part of the way into the niche until the composite shaft is level with the grooves on the sides of the niche, after which the springs are released, making the composite shaft expand and return to its original length and the caps project and enter the respective grooves.

The depth of the niche must be such as to accommodate the sanitary fixture, at least partially. The width and height of the niche are such as to allow the fixture to be inserted in the niche itself, inside which are all the connections and ducts to supply water for use and to discharge waste water.

The niche is preferable set higher than floor level to allow tiles to be laid below said niche, ensuring greater hygiene for the whole.

The means of rotating the fixture consists of projecting parts in the form of pivots protruding from the side of the niche and pointing towards each other on which are inserted the corresponding cavities provided at the bottom of the side walls, which face forwards and end in a part that can accommodate and rotate around said coaxial pivots. A washer can also be provided between the projecting parts and the cavity.

The means of holding the sanitary fixture are projecting caps that slide in a circular groove in the side walls of the niche, each groove having two ends, a top one to hold the respective cap when the fixture is pulled out and a bottom one to stop the cap when the fixture is inserted in the niche. The caps are fitted into a composite shaft that crosses the top of the more or less vertical rear wall.

In this way, when use is to be made of the fixture it is pulled out of the niche by means of a hollow in the front edge of the fixture; the fixture rotates around the projections in the niche and the projecting caps slide along the grooves until they reach the ends of the grooves where the fixture resets when its base is horizontal.

Since the ducts must follow the movements of the fixture, they have considerable freedom of movement, being in particular of the bellows type.

The sanitary fixture has a drain-trap that is envisaged in different positions according to the type of fixture, namely in the bidet it is envisaged at the end of the bellows-type waste pipe before the inlet to the pipe made fast to the floor, while in the water closet it is envisaged in the bowl of the fixture itself. The front part of the drain-trap is cup-shaped and inside this cup there extends a curved septum so that a certain amount of water is retained, enough to form a water plug, when the water closet is horizontal and when it is vertical.

The drain device can also consist of a fixed trap in the floor or a special valve, or forced draining can be provided, with a single pump or with two separate pumps (one to supply the water and one to expell the waste water).

To hide the ducts and all the devices connected to the sanitary fixture there are a front wall with suitable sloping parts and a plastic sheet attached at one end to a support inside the niche and at the other end to the rear edge of the sanitary fixture. When the fixture is pulled out the sheet is stretched tight and also adheres to the lower edge of the front wall; when the fixture is inserted into the niche the sheet folds along the back wall of the niche.

The sanitary fixture is preferably contained in a box-shaped element, the front wall of which is a panel in a single piece, the whole suitable for mounting flush to the wall, the bottom wall and possibly the rear wall being equipped with holes or slots.

The present invention according to a preferred but non-limiting embodiment, is illustrated in the attached drawings, in which.

Figure 1:
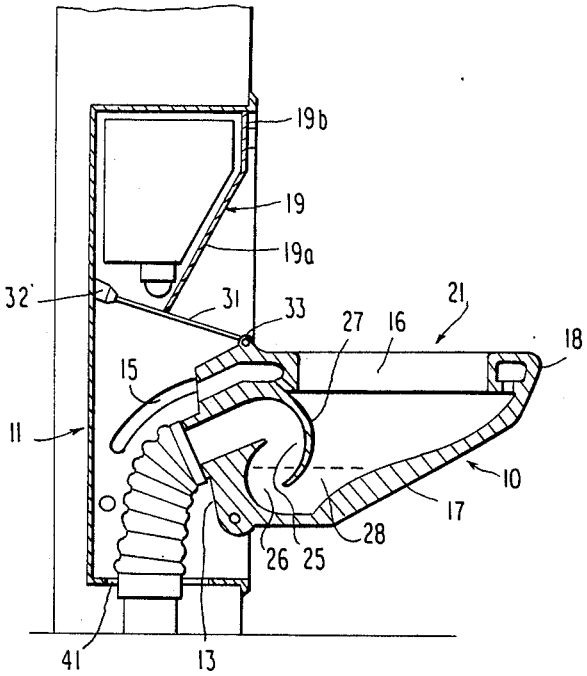
FIG. 1 shows a section along the axis of symmetry of a first sanitary fixture pulled out of the niche that accommodates it.

FIG. 1 shows a water closet sanitary fixture 10 pulled out of the niche 11 that accommodates it. The niche 11 is situated at a distance H from floor level and is equipped with a hole 41 in the bottom wall. The sanitary fixture has a triangular body, if viewed from the side, and an upper base 21 from which originate a more or less vertical rear wall 13, side walls 16 in the form of right-angled triangles and a sloping bottom 17. All the walls, apart from the rear one, meet along the front edge 18. The sanitary fixture moreover has hollows 23 (FIG. 7) situated at the bottom of the side walls 16 at their lowest point; each hollow accommodates a lateral projection 12 of the niche around which the sanitary fixture 10 can rotate to be pulled in or out of the niche 11.

The triangular side walls 16 are equipped with projecting caps 14 that slide in special arc-shaped grooves 15 provided in the side walls of the niche. Each groove 15 has ends to hold the respective projecting cap 14, i.e. the top end retains the projecting cap when the sanitary fixture is pulled out and its upper base is in a horizontal position and the bottom end stops the projecting cap when the fixture is pushed completely inside the niche 11.

Figure 2:
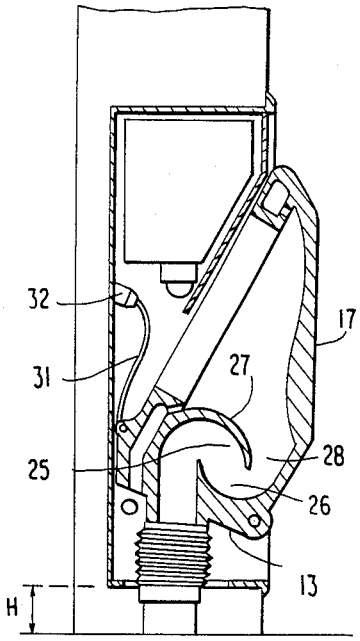
FIG. 2 shows a section along the axis of symmetry of a first sanitary fixture inserted inside the niche.

As can be seen in FIGS. 1 and 2, the niche also contains all the connections and ducts to supply water for use and to discharge waste water.

On the bottom of the fixture there is a drain-trap 25 consisting of a cup 26 inside which extends a cruve septum 27. The water plug 28 that comes to be formed at the bottom of the fixture in the horizontal position is also maintained when the fixture is inserted inside the niche in the vertical position (FIG. 2).

The front wall 19 of the niche, made up of sections **19*a* and 19*b*, screens the plumbing and the other devices (for example the flush tank) provided inside the niche. To complete the screen there is a plastic sheet 31 that is fixed at one end to a support 32 on the inside of the niche 11 and at the other end to the rear edge 33 of the santiary fixture. When the sanitary fixture is pulled out, the sheet 31 is stretched tight and adheres to the lower edge of the sloping section 19*a* of the front wall 19; when the fixture is pushed back the sheet 31 folds along the rear wall of the niche 11**.

In FIG. 2 the sanitary fixture is shown inserted inside the niche, from which only the bottom 17 protrudes.

Figure 3:
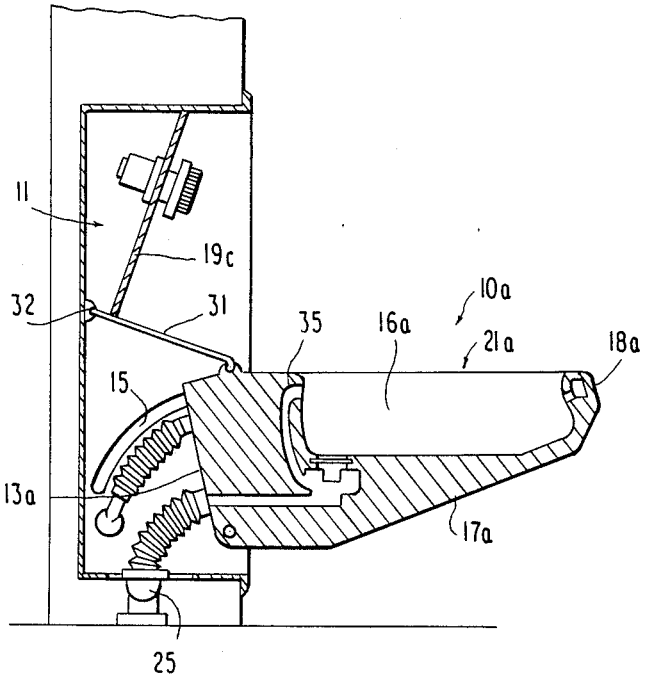
FIG. 3 shows a section along the axis of symmetry of a second sanitary fixture pulled out of the niche.
Figure 4:
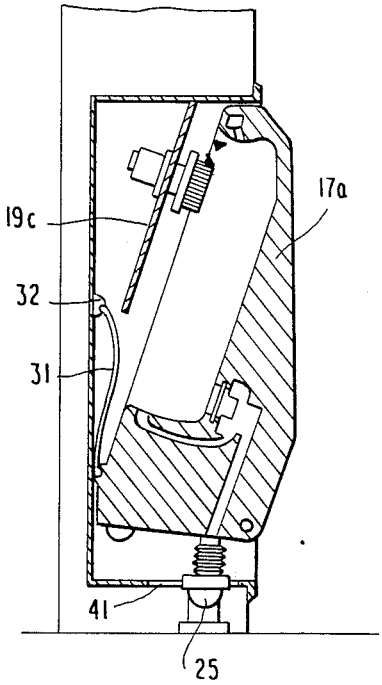
FIG. 4 shows a section along the axis of symmetry of the same second sanitary fixture inside the niche.

FIGS. 3 and 4 show a sectional view of a second type of sanitary fixture, namely a bidet **10*a*. It also is made up of a bottom 17*a*, a rear wall 13*a* and side walls 16*a* that meet in a front edge 18*a*. It has cavities 23 at the bottom of the side walls 16*a* and projecting caps 14 that slide in the grooves 15**.

The front wall of the niche is formed by the single sloping section **19*c*** that holds the mixer tap or taps.

The fixture has an overflow outlet 35.

Figure 5:
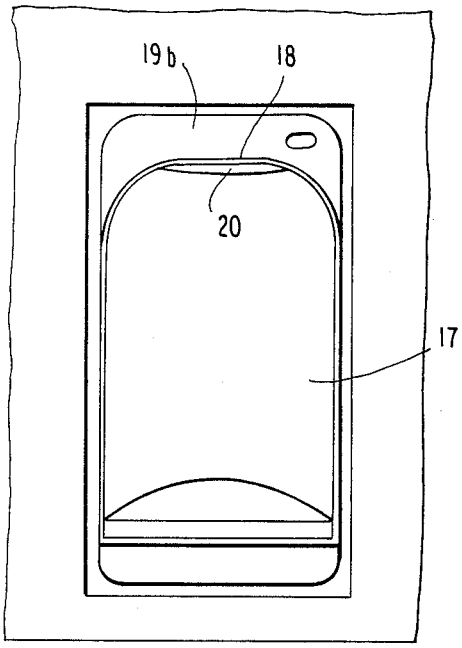
FIG. 5 shows a front view of the first sanitary fixture inside the niche.
Figure 6:
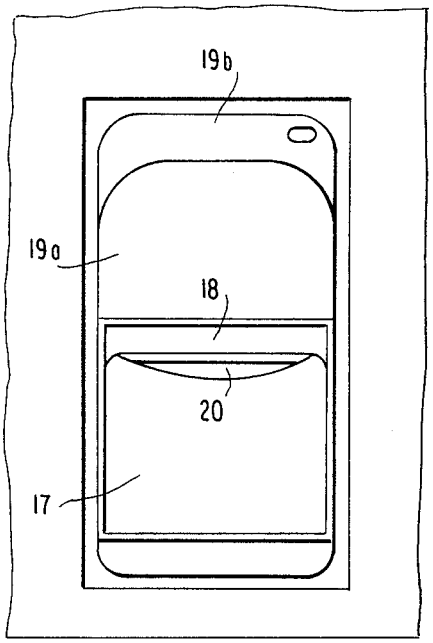
FIG. 6 shows a front view of the first sanitary fixture pulled out of the niche.

FIGS. 6 and 5 respectively refer to a front view of a water closet in the horizontal position, i.e. pulled out of the niche, and in the upright position, i.e. inserted inside the niche. It can be noted that underneath the front edge 18 a hollow 20 is provided, forming a grip to bring about rotation of the fixture.

Figure 7:
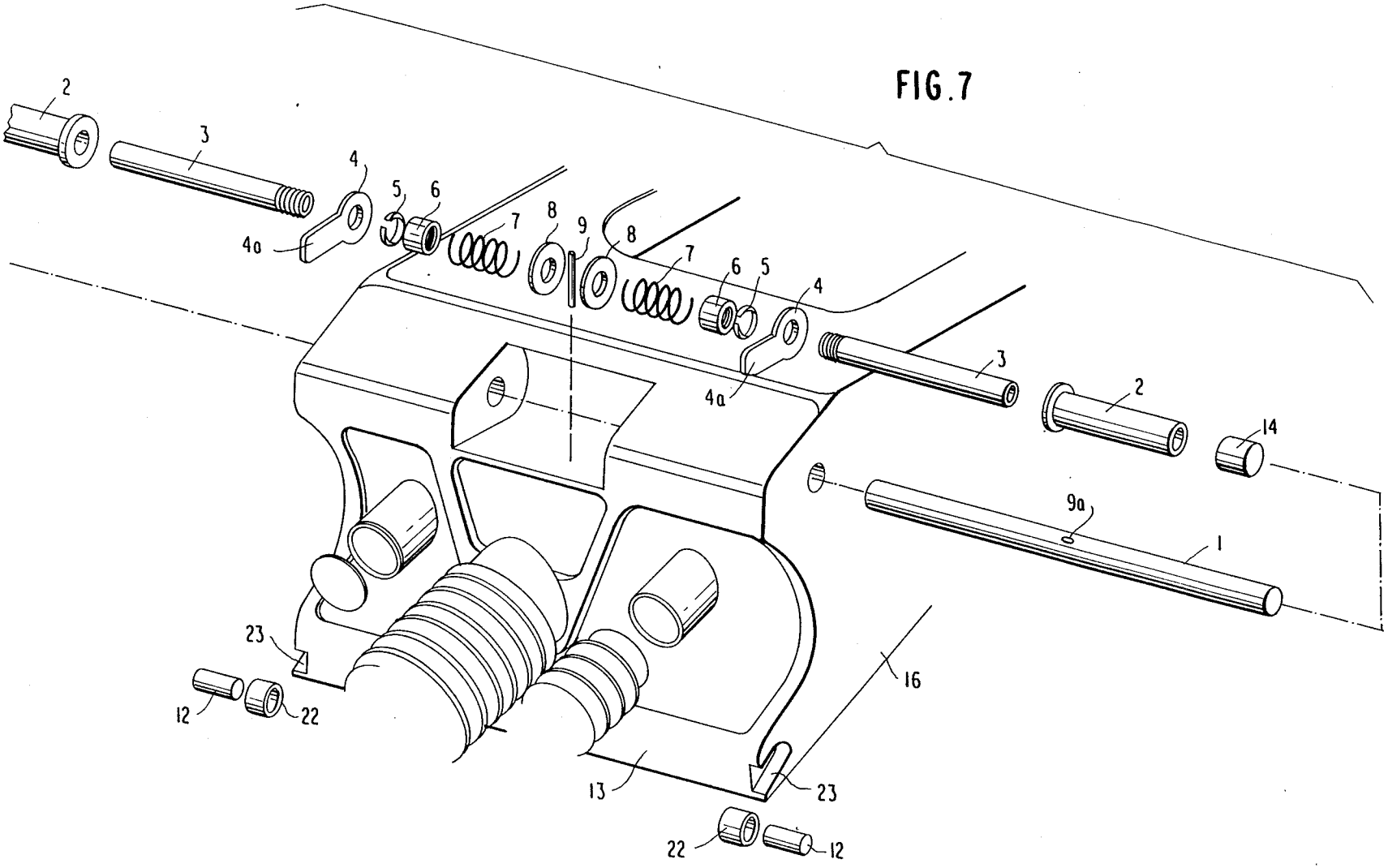
FIG. 7 shows a perspective view of a detail of the sanitary fixture.

FIG. 7 shows the detail of the rear wall 13 of the fixture into which the composite shaft equipped with projecting caps 14 is inserted into bushings 2. The through shaft 1 connects the tubular sections 3; it is fixed by a vertical stop 9 that enters a center hole **9*a* in the through shaft itself. The vertical stop 9 is held by washers 8 pushed by springs 7 that rest against nuts 6 screwed onto tubular sections 3. Between the edge of the bushings 2 and the nuts 6 are inserted plates 4 and washers 5, the plates 4 having projecting grips 4*a*. The projecting caps 14 are applied to the projecting ends of the tubular sections 3. The bushings 2 and the caps 14** are preferably made of teflon, while the other parts are in stainless steel.

During assembly, by pressing the springs 7 by means of the projecting grips **4*a*, the composite shaft is shortened and thus the caps 14 enter the seat in which the composite shaft is accommodated. The fixture, supported on the lower pivots, is inserted into the niche 11 until the composite shaft is level with the grooves 15 then the springs 7 are released and expand, restoring the composite shaft to its original length and the caps both project into the grooves 15**.

At the base of the rear wall and along the side walls are situated the cavities 23 to accommodate the corresponding lateral projections 12 provided in the niche, after inserting the washers 22 that are preferably made of teflon.

Figure 8:
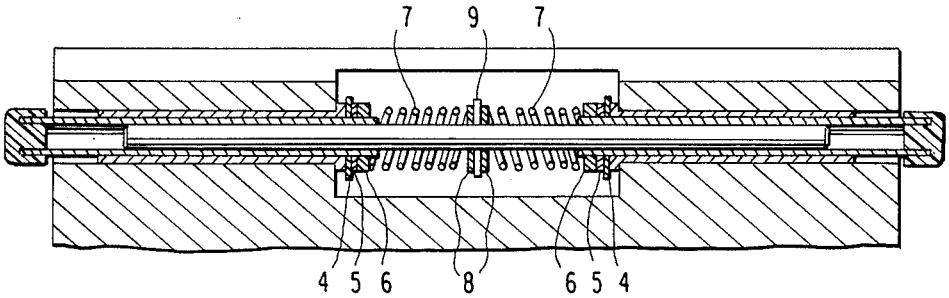
FIG. 8 shows a sectional view of a composite shaft fitted into a sanitary fixture.

FIG. 8 shows the assembled composite shaft. The caps 14 are applied to the projecting ends of the tubular sections 3.

I claim:

1. A sanitary rotating fixture (10, **10*a*), rotatably mounted in a niche (11) adapted to be set in a structural wall on which the fixture is fitted, said niche defined by top, bottom, side and back walls and an open front wall, said fixture comprising a flush receptacle substantially triangular in shape when viewed from the side, with a rear wall (13, 13*a*), an upper portion (21, 21*a*), sidewalls (16, 16*a*) and a sloping bottom (17, 17*a*); said receptacle including flush means in communication therewith through said rear wall for flushing said receptacle; hinge means horizontally disposed between said niche side walls for permitting rotation of said receptacle into and out of said niche open front wall through an angle of less than 90° and preferably an angle of about 60°; and a plastic sheet (31) fixed along one edge thereof to a support (32) secured to the niche back wall and along an opposite edge thereof to a top rear edge (33**) of the receptacle, said sheet extending between said niche side walls and being stretched tight when the receptacle is pulled out of said niche to conceal said flush means thereby preventing dirt accumulation thereon, and adapted to fold along the back wall of the niche when the receptacle is inserted in the niche.

2. A sanitary fixture according to claim 1 further comprising holding means for stopping outward rotation of said receptacle, said holding means including a pair of projecting caps (14) attached to and extending horizontally from said receptacle sidewalls which slide in arc-shaped grooves (15) formed in the side walls of the niche (11) whereby the rotation of the receptacle is stopped when the caps reach the ends of the grooves (15).

3. A sanitary fixture according to claim 1 wherein said hinge means comprises a pair of lateral projections (12) that protude from the side walls of the niche (11), corresponding cavities (23) formed in the bottom of the receptable side walls (16, 16*a*), and a bearing (22) positioned on each projection (12) and sealed in the cavaties (23).

4. A sanitary fixture according to claim 2 wherein the projecting caps (14) are fitted on opposite ends of a composite shaft mounted in a pair of bored bosses on the rear wall of the receptacle, said composite shaft comprising a central shaft (1) of a length which allows it to extend symmetrically and partly into both bosses, said central shaft having a pair of tubular sections (3) concentrically positioned over the ends thereof and extending through the bosses and having free ends that project from exterior sides of the bosses which receive the caps (14) thereon, the central shaft (1) being fitted with a pin (9) inserted in a central hole (9*a*) therein and with a first pair of washers (8) biased towards the pin from opposite sides thereof by a pair of springs (7) that rest against nuts (6) threaded onto the other ends of the tubular sections (3), the tubular sections (3) being inserted into a pair of bushings (2) each having a flanged end and of a length dimension less than that of the tubular sections, the bushings being positioned with respect to the tubular sections such that the flanged ends thereof are near the threaded ends of the tubular sections, a second pair of washers (5) and a pair of plates (4) with projecting tabs (4) are positioned between the nuts (6) on the tubular sections and the flanges of the bushings (2) such that compression of the springs (7) through inwardly directed force on the tabs (4*a*) draws the caps (14) into the bores of the bosses to allow the receptacle to be inserted between the niche side walls whereupon release of the tabs allows the caps to be biased into seating engagement with the grooves (15).

5. A sanitary fixture according to claim 1 wherein said niche open front wall comprises an open lower portion for allowing rotation of said receptacle, and a closed upper portion (19*a* and 19*b* or 19*c*).

6. A sanitary fixture according to claim 1 wherein said niche is box-shaped and said open front wall (19) includes a peripheral flange suitable for mounting flush to the structural wall.

7. A sanitary fixture according to claim 1 wherein said receptacle has a drain-trap (25) comprising a cup (26) inside which extends a curved partition (27) thus forming a water plug (28) that is maintained even when the water closet is rotated and inserted inside the niche.

8. A sanitary fixture according to claim 1 wherein said flush means comprises a fixed trap adapted to be positioned in a structural floor supporting the structural wall.

9. A sanitary fixture according to claim 1 wherein said receptacle has forced drainage and said flush means includes a single pump.

10. A sanitary fixture according to claim 1 wherein said receptacle has forced drainage and said flush means includes, one to supply water and one to discharge it.

11. A sanitary fixture according to claim 1 wherein a front edge (18, 18*a*) of the receptacle includes a hollow (20) formed therein forming a grip means for rotation of the fixture.

12. A fixture according to claim 1 wherein said flush means includes ducts for supply of water for use and for discharge which allow considerable freedom of movement and they are of the bellows type.

* * * * *